United States Patent [19]

Chambers et al.

[11] 4,325,162

[45] Apr. 20, 1982

[54] APPARATUS FOR COLLECTING MINERAL-BEARING DEBRIS

[76] Inventors: Earl W. Chambers, 23165 Eastbrook Ave.; John L. Doglietto, 23175 Eastbrook Ave., both of Los Altos, Calif. 94022

[21] Appl. No.: 154,466

[22] Filed: May 29, 1980

[51] Int. Cl.[3] ..... A47L 9/32

[52] U.S. Cl. ..... 15/327 C; 15/339; 15/352; 15/353

[58] Field of Search ..... 15/327 C, 327 F, 353, 15/339, 352, 314

[56] References Cited

U.S. PATENT DOCUMENTS

| | | | |
|---|---|---|---|
| 1,047,164 | 12/1912 | Butenschoen | 15/327 C X |
| 2,033,833 | 3/1936 | Kent | 15/339 X |
| 2,346,339 | 4/1944 | Vose | 15/352 X |
| 3,599,273 | 8/1971 | Shirayanagi | 15/327 C X |
| 3,942,217 | 3/1976 | Bates | 15/353 X |
| 4,055,405 | 10/1977 | Thun-Hohenstein | 15/353 X |

OTHER PUBLICATIONS

"Look, Up in the Sky", Washington Star, 9-23-77.

*Primary Examiner*—Chris K. Moore
*Attorney, Agent, or Firm*—Gerald L. Moore

[57] ABSTRACT

A portable blower device for picking up debris in which minerals such as gold may be deposited in cracks and crevices and the like. A blower assembly is mounted with a harness for carrying on the back of the user to create a vacuum for pulling air through a flexible tube connecting with a container. Leading from the collector container is a second hose connecting with an elongated hollow tubular member which can be inserted into cracks and crevices for drawing out debris and minerals for deposit in the collector. The device is compact and easily portable and, by insertion of the collector into the harness, can be hand-carried as a unit.

4 Claims, 5 Drawing Figures

FIG. 3
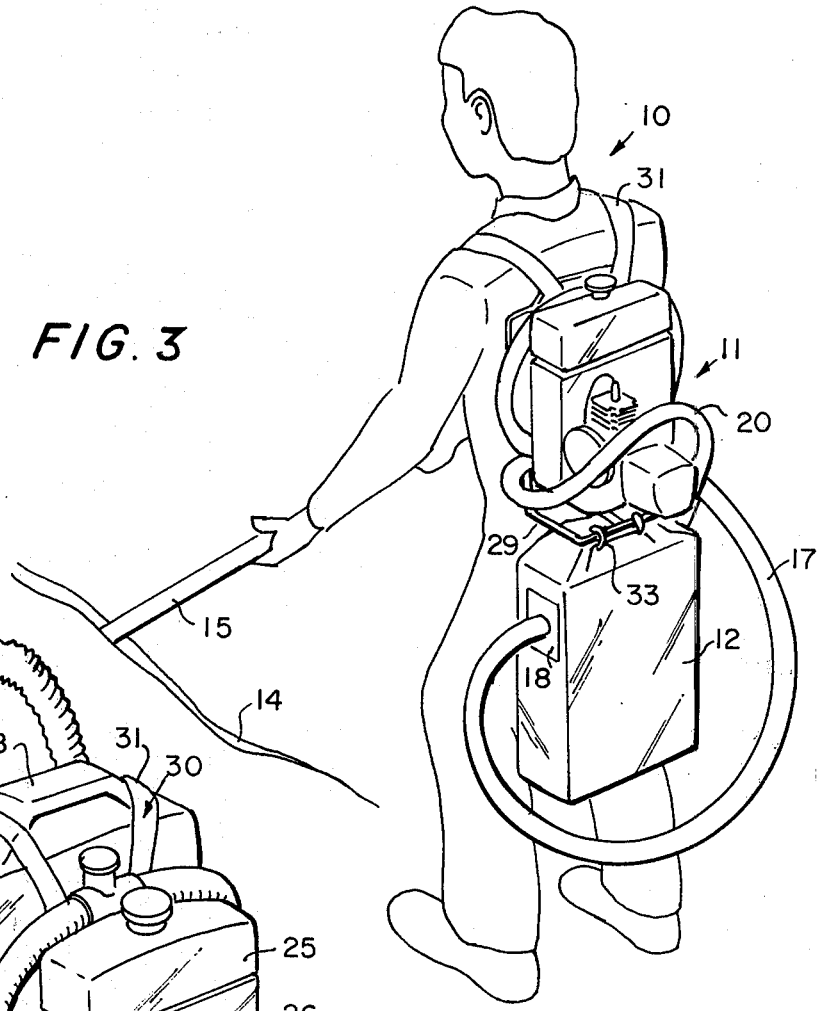
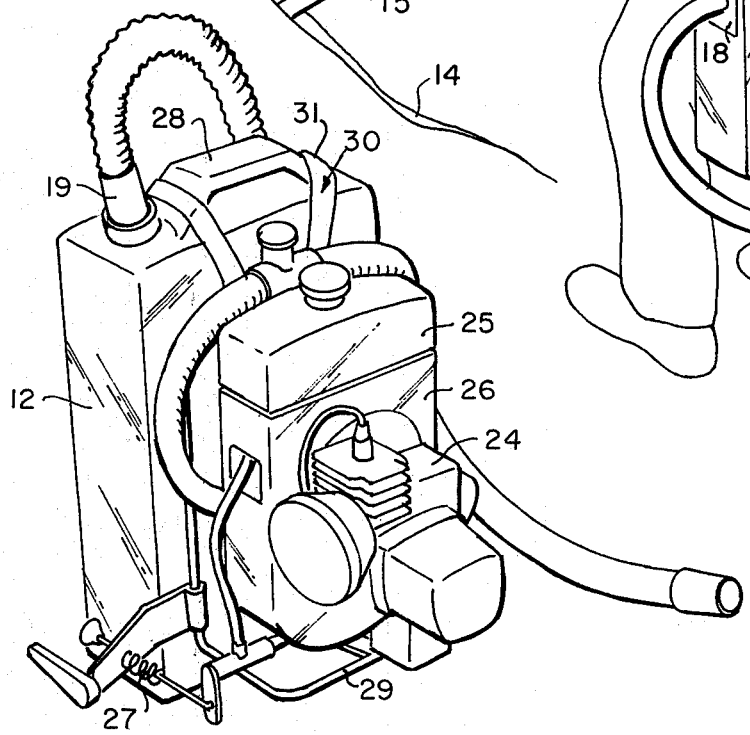
FIG. 2.

APPARATUS FOR COLLECTING MINERAL-BEARING DEBRIS

BACKGROUND OF THE INVENTION

The present invention has many purposes but the primary purpose is to facilitate searching for gold dust and nuggets on dry land and in dry creek beds. It is well-known that during the rainy winter season in the gold country, water washes down gulleys and creek-beds which during a great part of the remainder of the year are dry. This water frequently carries with it gold dust or nuggets which have been dislodged at higher elevations. When the water runs over cracks and crevices in rock there is created a natural sluicing action which tends to deposit the heavier gold carrying particles in the cracks and wash the lighter dirt, rocks and other debris away.

Many gold seekers visit these areas after the winter rains when the creekbeds are dry to search the various cracks and crevices for gold nuggets or dust. However, such crevices frequently are too deep and narrow for the insertion of the hand to recover any nuggets and of course it is substantially impossible to retrieve any gold dust that might lie at the crevice bottom. Additionally the task is laborious and time-consuming.

It is the primary purpose of the present invention to provide a portable collecting apparatus for the efficient removal of rocks, debris and soil from such crevices for subsequent processing to remove any gold that might be in the debris.

SUMMARY OF THE INVENTION

Apparatus for collecting mineral-bearing debris comprising a portable self-powered blower assembly having an intake port connected by a flexible hollow tube to a closed collector. The collector is a closed container having both intake and exhaust openings with a second flexible tube connected to the intake opening. When this second flexible tube is brought into contact with the debris, the debris is pulled into the collector and deposited there while the air passes out the exhaust and through the blower assembly. By allowing the blower and collector to be positioned remote to each other, the collector can be monitored by the user to determine when it is full. Also the blower can be positioned on level ground away from the rough terrain where the debris is frequently collected.

The apparatus is lightweight and easily transported by means of a harness fastened to the blower assembly which can be attached to the user's back. Additionally provisions are made for attaching a flexible hose at another connection for blowing air out to dry sluice the material for the separation of gold from debris.

DESCRIPTION OF THE DRAWINGS

FIG. 2 is a perspective view of the blower assembly and collector assembled for hand-carrying;

FIG. 3 is a perspective view of the invention being carried by the user;

Figure 1:
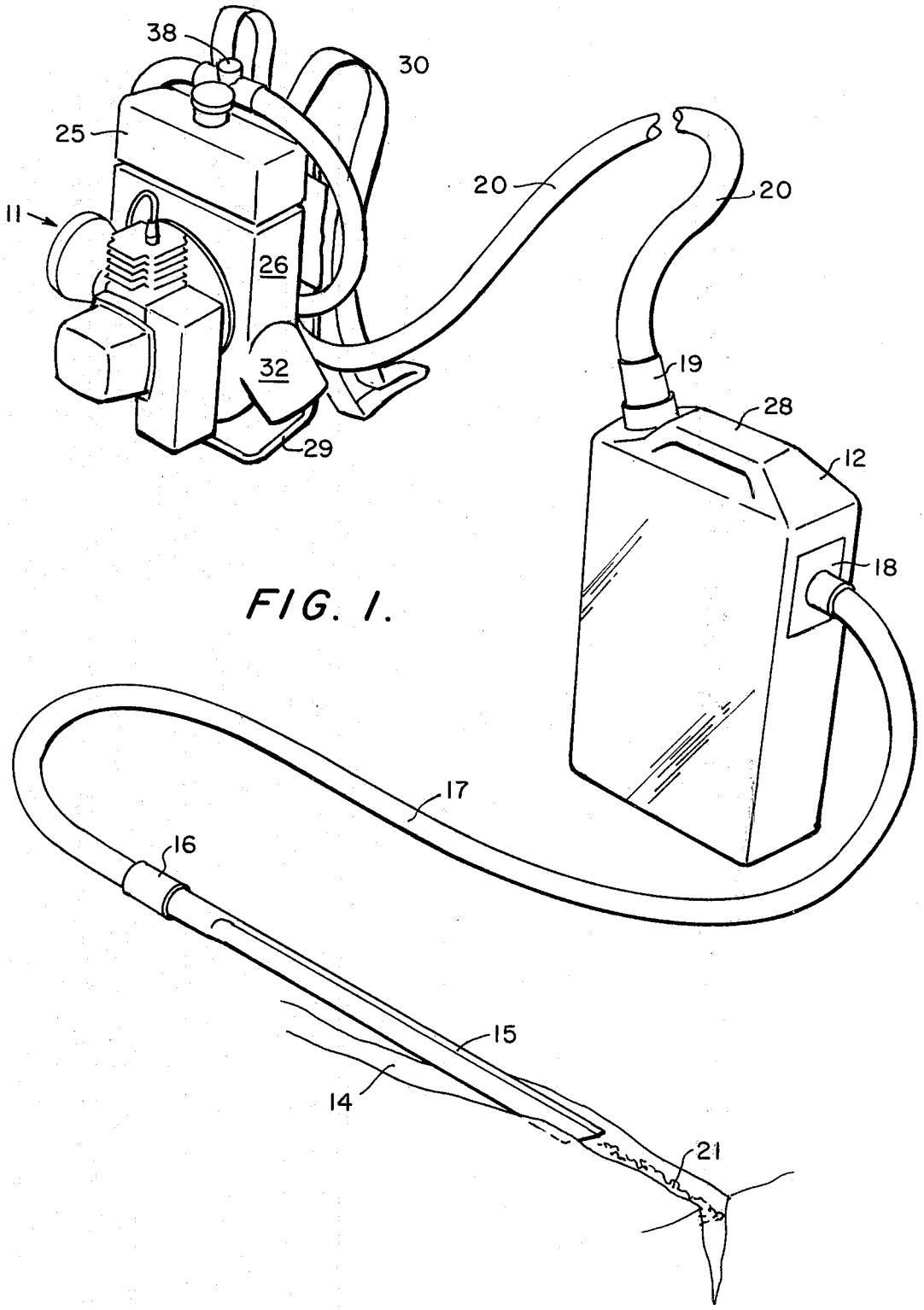
FIG. 1 is a perspective view of the invention.
Figure 4:
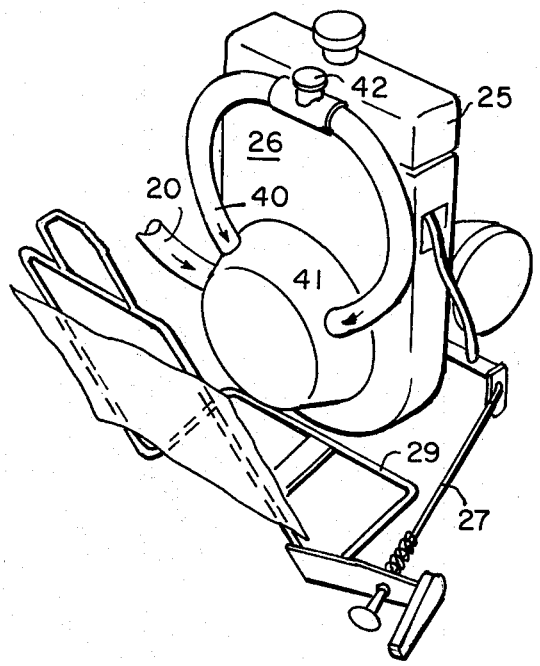
FIG. 4 is a view of the blower with the harness removed.

DESCRIPTION OF THE INVENTION in FIG. 1 is shown the invention comprising a blower assembly 11 and a collector 12. The primary use for the invention is to enable the removal of debris from remote areas such as the crevice 14 where gold nuggets and dust might be deposited during the normal sluicing action of mountain streams in the gold country. For this purpose the invention serves to remove debris and rock and other matter from the crevice by the insertion of a flat tubular member 15 into the crevice. The tubular member is a hollow tube 15 connected at the one end by the connector 16 to the flexible tube 17 and at the other end by a connector 18 to the collector 12. Thus the blower assembly 11 serves to pull air through the flexible tube 20, the collector 12, the flexible tube 17 and the tubular member 15 which air picks up and carries debris 21 which subsequently is deposited in the collector. The air flow is created by the blower assembly 11 comprising a gasoline-powered engine 24, a gasoline tank 25, a blower unit 26 and a throttle linkage 27.

The blower assembly is sufficiently compact for easy transportation and handling. Attached to the blower assembly is an L-shaped frame 29 to which is connected a harness 30 comprising shoulder straps 31 which fit over the shoulders of the user in the manner shown in FIG. 3. Padding on the frame cushions the user's back. As shown the collector 12 can be hung from the bottom of the frame 29 by a cord or hanger 33 so as to make use of the harness 30 in carrying the device. In this manner the unit is made completely portable and allows both hands of the user to be free to handle the tubular member 15 in picking up the debris. The apparatus is used in this manner when the user must move constantly and the quantity of debris to be picked up is not great.

As indicated primarily in FIG. 1, the collector comprises a closed container preferably made of plastic, aluminum or other lightweight and durable material. The collector includes the fitting 19 and also has a handle 28 for easy transportation. The air enters the flexible tube 17 and carries with it debris. Because the exhaust fitting 19 is positioned higher than that of the intake fitting 18 and also not directly aligning therewith, the air swirls around within the collector and any heavy particles will drop down into the collector bottom and not be carried out the exhaust port by the continuing air flow. The flowing air must make a 90° change in direction to exit the exhaust port and flow into the flexible tube 20 thereby throwing or dropping the debris and allowing it to settle into the bottom of the collector. By reason of the swirling action within the collector, the lightweight dirt or dust is predominantly carried on through the exhaust tube 20 and the blower unit to be exhausted therefrom through the exhaust port 32. Thus there is a normal sluicing action within the collector which serves to clean away the lightweight particles and dust and leave the heavier rocks and the gold particles or other minerals being sought. Such sluicing action can be enhanced by shaking the collector periodically to uncover the lightweight debris, dirt and leaves.

As shown also in FIG. 2 the unit is also constructed in a manner to form a hand portable unit if it is not desired to transport the unit on the back. This configuration is mainly used while carrying the apparatus to the setup location. For this reason the collector is constructed so as to receive the harness straps 30 therearound to secure the collector to the blower assembly in one compact unit. The handle 31 of the collector can be grasped for moving the apparatus short distances as would be necessary as the user proceeds to position and get ready for setting up the apparatus.

In practice the apparatus is generally used in the configurations shown in FIGS. 1 and 3. In FIG. 1 the blower assembly and collector are positioned remote as is frequently necessary in rough terrain. By positioning the collector near the user's location, it can be constantly monitored to determine when it is full. Usually more than one collector is used so that an empty one can be substituted when the first one is full. In this way debris can be collected in larger amounts or other place. A partial sluicing of the debris can be achieved by carefully shaking the collector while the blower assembly is operated, thereby allowing the swirling air passing through the collector to pick up the lightweight dust and leaves.

Figure 5:
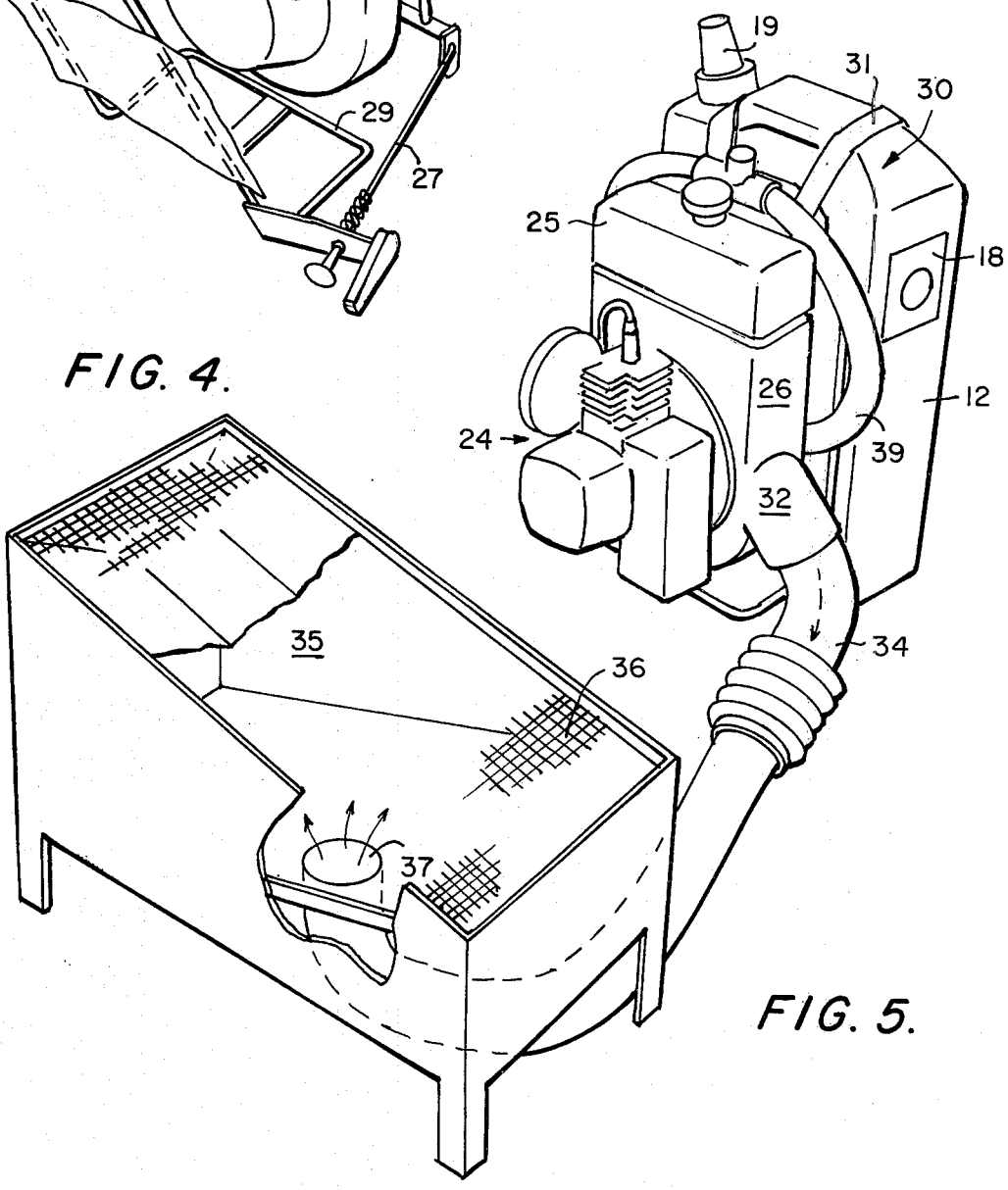
FIG. 5 shows the apparatus connected to a dry sluice box for separating gold from debris.

In accordance with another feature of the invention the blower assembly can be used for sluicing in the manner shown in FIG. 5 by connecting a large flexible tube 34 to the single exhaust port 32 of the blower unit. For this purpose the blower assembly is operated and the exhaust is fed into a suitable sluice box 35 having a grill 36 therein onto which the debris can be shoveled. With the air exiting the port 37 in the bottom of the sluice box the lightweight particles are blown off the grid while the heavier particles fall down into the sluice box or remain on the grill. A dry sluicing of the mineral-bearing material and debris is achieved for separation of the lightweight particles from the heavier particles. Naturally the heavier particles may contain the gold or minerals being sought.

In accordance with another feature of the invention there is provided a regulated port 38 connecting with a third flexible tube 39 which is attached to second and third intake ports 40 and 41 of the blower assembly. The intake 38 can be opened when it is desired to regulate the air flow through the blower unit to feed more air into the blower such as when the tube 34 is connected for dry sluicing in the manner previously described. In addition the flexible tube 17 can be connected to the coupling 34 for obtaining a supply of pressured air which can be blown into crevices and so forth if debris needs to be cleaned out and it is not desired to pick up this debris. For instance one might use this feature to clean away leaves from an area prior to initiating the picking up of debris which might bear minerals. By providing the port 38 connecting with the second and third intake ports 40 and 41, the air flow through the blower unit can be regulated somewhat to adjust the air flow used in picking up debris. In this instance the air flow is regulated merely by removing a cap 42 normally closing the port 38, but other more accurate flow-regulating means can be used if needed. The primary reason for providing the port 38 is to regulate air flow during blowing. However if two people went to work with the machine at the same time, flexible hoses can be attached to the collector and to the coupling 34 and a blowing action is provided through one flexible hose while a sucking action is provided through the other tube.

The invention claimed:

1. Apparatus for collecting soil and rocks from remote crevices and the like comprising:

a portable self-powered blower assembly having a first exhaust port and first intake port;

a collector separated from said blower assembly and comprising a closed container having an intake opening and an exhaust opening;

a harness for mounting said blower on the user's back;

a first flexible hollow tube connecting the intake port of said blower with the exhaust opening of the collector;

a rigid tubular elongated hollow member having one end suitable for probing remote crevices and a second end adapted for attachment to a flexible tube;

a second flexible hollow tube connecting the intake opening of the collector with the tubular member second end whereby the blower assembly can be energized to create a vacuum air flow inward through the rigid member for picking up soil and rocks;

second and third intake ports connecting with said blower assembly with a third flexible tube connected therebetween; and a flow-regulating intake port connecting with said third flexible tube to regulate the flow of air through said blower assembly.

2. Apparatus as defined in claim 1 wherein said first exhaust port includes means for connecting a fourth flexible tube to provide outward blowing air through said fourth tube.

3. Apparatus for collecting soil and rocks from remote crevices and the like comprising:

a portable self-powered blower assembly having a first exhaust port and first intake port;

a collector separated from said blower assembly and comprising a closed container having an intake opening and an exhaust opening;

a harness for mounting said blower on the user's back and wherein said harness can be placed around said collector to mount the collector on said blower and provide a compact and easily portable apparatus;

a first flexible hollow tube connecting the intake port of said blower with the exhaust opening of the collector;

a rigid tubular elongated hollow member having one end suitable for probing remote crevices and a second end adapted for attachment to a flexible tube; and a second flexible hollow tube connecting the intake opening of the collector with the tubular member second end whereby the blower assembly can be energized to create a vacuum air flow inward through the rigid member for picking up soil and rocks.

4. Apparatus for collecting soil and rocks from remote crevices and and the like comprising:

a portable self-powered blower assembly having a first exhaust port and first intake port;

a collector separated from said blower assembly and comprising a closed container having an intake opening and an exhaust opening;

a harness for mounting said blower on the user's back;

a first flexible hollow tube connecting the intake port of said blower with the exhaust opening of the collector;

a rigid tubular elongated hollow member having one end suitable for probing remote crevices and a second end adapted for attachment to a flexible tube;

a second flexible hollow tube connecting the intake opening of the collector with the tubular member second end whereby the blower assembly can be energized and to create a vacuum air flow inward through the rigid member for picking up soil and rocks and means to removably connect said collector to said blower assembly so both may be carried as a unit including a hanger for hanging the collector from the bottom of the blower assembly.

* * * * *